US006932452B2

(12) United States Patent
Nou

(10) Patent No.: US 6,932,452 B2
(45) Date of Patent: Aug. 23, 2005

(54) ON-DEMAND INKJET PRINTER AND DRIVE METHOD AND DRIVE CIRCUIT FOR SAME

(75) Inventor: Hiroshi Nou, Kawasaki (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 209 days.

(21) Appl. No.: 10/253,506

(22) Filed: Sep. 25, 2002

(65) Prior Publication Data

US 2003/0025744 A1 Feb. 6, 2003

Related U.S. Application Data

(63) Continuation of application No. PCT/JP00/02140, filed on Mar. 31, 2000.

(51) Int. Cl.[7] ..... B41J 29/38; B41J 2/205
(52) U.S. Cl. ..... 347/10; 347/15
(58) Field of Search ..... 347/12–15, 40–43, 347/9, 10, 11

(56) References Cited

U.S. PATENT DOCUMENTS

| | | | | |
|---|---|---|---|---|
| 5,610,637 A | | 3/1997 | Sekiya et al. | |
| 5,657,060 A | | 8/1997 | Sekiya et al. | |
| 5,729,257 A | | 3/1998 | Sekiya et al. | |
| 5,877,786 A | * | 3/1999 | Sekiya et al. | 347/15 |
| 6,283,568 B1 | | 9/2001 | Horii et al. | 347/40 |
| 6,328,395 B1 | | 12/2001 | Kitahara et al. | 347/9 |
| 6,341,832 B1 | * | 1/2002 | Narushima | 347/14 |

FOREIGN PATENT DOCUMENTS

| | | |
|---|---|---|
| EP | 0 856 986 A2 | 8/1998 |
| JP | 4-341060 | 11/1992 |
| JP | 6-297717 | 10/1994 |
| JP | 10-81014 | 3/1998 |
| JP | 10-211721 | 8/1998 |
| JP | 11-5298 | 1/1999 |
| JP | 11-78005 | 3/1999 |
| JP | 11-115221 | 4/1999 |
| JP | 11-115251 | 4/1999 |
| JP | 2000-52570 | 2/2000 |

* cited by examiner

*Primary Examiner*—Stephen Meier
*Assistant Examiner*—An H. Do
(74) *Attorney, Agent, or Firm*—Armstrong, Kratz, Quintos, Hanson & Brooks, LLP.

(57) ABSTRACT

In an inkjet head, both tones and smoothing can be represented suitably through use of a small number of drive waveforms. A drive waveform generator unit (46) generates drive waveforms for emitting a ink particle to form dots of a same size within one cycle that is an integral fraction of the cycle for one pixel, a print data generator unit (42) generates print data of a plurality of bits for selecting said drive waveform in said cycle for one pixel, and a head drive unit (47) drives the nozzles of said head by selecting said drive waveform in accordance with said print data. Thereby, tones and smoothing can be represented suitably, through use of a small number of different waveforms.

33 Claims, 12 Drawing Sheets

FIG. 10
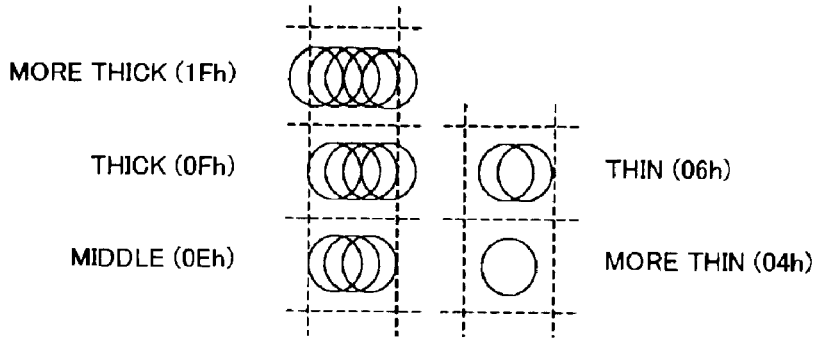
FIG. 11
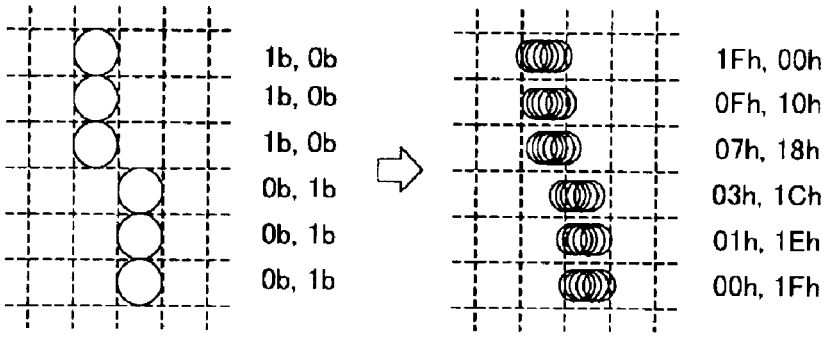
FIG. 12
| HEXADECIMAL NOTATION CODE | BIT DATA | DOT PATTERN | |
|---|---|---|---|
| 0 0 | 0 0 0 0 0 | | TONE LEVEL 0 |
| 0 4 | 0 0 1 0 0 | | TONE LEVEL 1 |
| 0 6 | 0 0 1 1 0 | | TONE LEVEL 2 |
| 0 E | 0 1 1 1 0 | | TONE LEVEL 3 |
| 0 F | 0 1 1 1 1 | | TONE LEVEL 4 |
| 1 F | 1 1 1 1 1 | | TONE LEVEL 5 |
| 1 0 | 1 0 0 0 0 | | SMOOTHING PATTERN |
| 1 8 | 1 1 0 0 0 | | 〃 |
| 1 C | 1 1 1 0 0 | | 〃 |
| 0 C | 0 1 1 0 0 | | 〃 |
| 0 E | 0 1 1 1 0 | | 〃 |
| 0 6 | 0 0 1 1 0 | | 〃 |
| 0 7 | 0 0 1 1 1 | | 〃 |
| 0 3 | 0 0 0 1 1 | | 〃 |
| 0 1 | 0 0 0 0 1 | | 〃 |
| 0 8 | 0 1 0 0 0 | | 〃 |
| 0 2 | 0 0 0 1 0 | | 〃 |
| 1 E | 1 1 1 1 0 | | 〃 |
| 0 F | 0 1 1 1 1 | | 〃 |
| 1 1 | 1 0 0 0 1 | | 〃 |
| 1 9 | 1 1 0 0 1 | | 〃 |
| 1 D | 1 1 1 0 1 | | 〃 |
| 1 7 | 1 0 1 1 1 | | 〃 |
| 1 3 | 1 0 0 1 1 | | 〃 |
| 1 B | 1 1 0 1 1 | | 〃 |
48

48

| OCTAL NUMBER CODE | A1B1C1 | A2B2C2 | A3B3C3 | DOT PATTERN | |
|---|---|---|---|---|---|
| 0 0 0 | 0 0 0 | 0 0 0 | 0 0 0 | | TONE LEVEL 0 |
| 0 2 0 | 0 0 0 | 0 1 0 | 0 0 0 | · | TONE LEVEL 1 |
| 0 3 0 | 0 0 0 | 0 1 1 | 0 0 0 | | TONE LEVEL 2 |
| 1 3 0 | 0 0 1 | 0 1 1 | 0 0 0 | ·· | TONE LEVEL 3 |
| 1 3 2 | 0 0 1 | 0 1 1 | 1 0 0 | ·.. | TONE LEVEL 4 |
| 0 4 0 | 0 0 0 | 1 0 0 | 0 0 0 | ● | TONE LEVEL 5 |
| 1 4 2 | 0 0 1 | 1 0 0 | 0 1 0 | ·●· | TONE LEVEL 6 |
| 4 4 0 | 1 0 0 | 1 0 0 | 0 0 0 | ●● | TONE LEVEL 7 |
| 4 4 4 | 1 0 0 | 1 0 0 | 1 0 0 | ●●● | TONE LEVEL 8 |

ON-DEMAND INKJET PRINTER AND DRIVE METHOD AND DRIVE CIRCUIT FOR SAME

This application is a continuation of international application PCT/JP00/02140, filed on Mar. 31, 2000.

TECHNICAL FIELD

The present invention relates to an on-demand inkjet printer for jetting ink according to demand, and a drive method and drive circuit for same, and more particularly, to an on-demand inkjet printer, drive method and drive circuit for same capable of tonal representation for each pixels and edge smoothing.

BACKGROUND ART

Inkjet printers are widely used as low-cost printers. In an inkjet printer of this kind, rather than simply printing characters, it is necessary to print images. Therefore, tonal representation for each pixels and edge smoothing is required.

On the other hand, in laser printers, this can be achieved readily by varying the size of the dots, and altering the dot positions by pulse width modulation of the laser. However, in an inkjet printer, it is not easy to control the dot position or dot size at each nozzle. One of the reasons for this is that, whereas a laser printer performs all drawing operations by switching a single laser beam on and off, in an inkjet printer, many features of the printer depend on the particular head composition of the serial printer and the particular drive method of the inkjet printer, namely, that the nozzles are disposed in a vertical and horizontal lattice configuration, and that a common drive waveform is supplied to the drive elements driving each nozzle.

For the above reasons, it is difficult to perform control whereby the jet timing of a certain nozzle is shifted independently, and consequently, control of individual dot positions is difficult. In the case of a system for controlling the timing by providing independent drive sources for each nozzle, although such control is technically possible, given the fact that nozzles are currently increasing in number, this cannot be seen as a practicable system, from the viewpoints of circuit size or cost.

Furthermore, in an inkjet head using thermal elements, in order to reduce costs, time division matrix driving is implemented whereby the total group of nozzles are divided into a plurality of blocks, and each plurality of nozzles is driven simultaneously, and this means that it is just as difficult to shift the timing for one particular nozzle as it is with a piezoelectric system.

Therefore, in the prior art, proposals have been made for achieving tonal representation and smoothing in the case of inkjet heads.

The first such proposal is a method for changing the size of the recorded dot for one pixel by altering the amount of ink emitted, tonal representation being achieved by variation of the dot size, and smoothing being achieved by selecting the dot size (for example, Japanese Patent Laid-open No. H11-5298, Japanese Patent Laid-open No. H11-78005, and the like.)

The second represents each pixel as a plurality of dots of different diameters, and achieves tonal representation by varying the number of dots (for example, Japanese Patent Laid-open No. H11-115221, Japanese Patent Laid-open No. H10-81014, and the like).

However, the first drive method of the prior art requires a different drive waveform for each tone graduation, and hence it is difficult to achieve a low unit price. Moreover, although the size of the dots changes, the position remains the same, and therefore, whilst this is acceptable for tonal representation, it is not suitable for smoothing.

The second drive method of the prior art is able to control the number of dots per pixel, but it is essentially an extension of the first prior art method, and since it assumes a large number of tone graduations, a plurality of dots of different sizes are positioned within one pixels and hence the method is suitable for tonal representation, but it is not suitable for smoothing. And furthermore, similarly to the first prior art method, it requires a large number of different drive waveforms, which makes it difficult to achieve a low unit price.

DISCLOSURE OF THE INVENTION

It is an object of the present invention to provide an inkjet printer, and a drive method and drive circuit for same, whereby both tones and smoothing can be represented appropriately.

It is a further object of the present invention to provide an inkjet printer, and a drive method and drive circuit for same, whereby both tones and smoothing can be represented appropriately by means of a small number of different drive waveforms.

It is yet a further object of the present invention to provide an inkjet printer, drive method and drive circuit for same, whereby both tones and smoothing can be represented appropriately, by means of simple control, even in the case of a multiple nozzle printer.

The on-demand inkjet printer according to the present invention includes: an inkjet head which moves in the main scanning direction of a recording medium; a drive waveform generator section for generating a drive waveform for emitting a ink particle to form dots of a same size, in a cycle that is an integral fraction of the cycle for one pixel; a print data generator unit for generating print data of a plurality of bits for selecting the drive waveform in the cycle for one pixel; and a head drive unit for driving the nozzles of the head, by selecting the drive waveform in accordance with the print data.

The drive device for an inkjet head according to the present invention includes: a drive waveform generator unit for generating a drive waveform for emitting a ink particle to form dots of a same size, in a cycle that is an integral fraction of the cycle for one pixel; a print data generator unit for generating print data of a plurality of bits for selecting the drive waveforms in the cycle for one pixel; and a head drive unit for driving the nozzles of the head, by selecting the drive waveform in accordance with the print data.

The drive method for an inkjet head according to the present invention includes: a drive waveform generating step for generating a drive waveform for emitting a ink particle to form dots of a same size, in a cycle that is an integral fraction of the cycle for one pixel; a print data generating step for generating print data of a plurality of bits for selecting the drive waveform in the cycle for one pixel; and a head driving step for driving the nozzles of the head, by selecting the drive waveform in accordance with the print data.

The present invention adjusts the head drive frequency and head carrier movement speed in such a manner that adjacent dots of the same size overlap by one half or more within one pixel. For this purpose, the cycle of the drive waveform (DRV) is set to an integral fraction of one cycle of the print control signal (for one pixel). By adopting this control method, one cycle of the print control signals, or namely, one pixel, can be represented by a plurality of dots of the same size. Moreover, each nozzle is switched on and off at desired times within one cycle of the print control signals, in accordance with the print data, and hence the positions of individual dots within one pixel can be shifted independently. Thereby, tones and smoothing can be represented suitably, by means of a small number of different waveforms.

Moreover, according to the present invention, the head drive unit includes switches for selecting the drive waveform, and shift registers for operating the switches, by shifting the print data within the cycle for one pixel, whereby the dot sizes and dot positions in one pixel can readily be controlled independently.

Furthermore, according to the present invention, the print data generating unit generates print data in such a manner that the dots selected within the cycle for one pixel are continuous, whereby, even if a plurality of dots are allocated to one pixel, the dots are not dispersed, and hence both tones and smoothing can be represented suitably.

Moreover, according to the present invention the print data generator unit includes a decoder for generating print data corresponding to a tone level for the one pixel and generating print data corresponding to a smoothing pattern, whereby both tones and smoothing can be represented suitably by using a function for controlling the aforementioned dot sizes and dot positions for one pixel, independently.

Furthermore, according to the present invention, drive waveform generator unit includes: a first drive waveform generator unit for generating a first drive waveform for emitting ink particles to form dots of a first same size within a cycle that is an integral fraction of the cycle for one pixel; and a second drive waveform generator unit for generating a second drive waveform for emitting ink particles to form dots of a second same size, respectively, within a cycle that is an integral fraction of the cycle for one pixel; and the head drive unit includes a drive unit for driving the nozzles of the head by selecting the first drive waveform or the second drive waveform, in accordance with the print data.

Thereby, even if the amount of ink is controlled, since tonal representation can be achieved by means of both the amount of ink and the number of dots, it does not matter if the dynamic range of the amount of ink is narrow, compared to a conventional dot toning head. For example, in the prior art, a dynamic range of 5 to 40 pl has been required, but in the present invention, a range of approximately 5 to 20 pl is sufficient. This means that the processing accuracy of the head can be reduced, and also leads to easier manufacture of the high-frequency drive head.

Further objects and embodiments of the present invention will become apparent from the following description of the preferred embodiments and the accompanying drawings.

BRIEF DESCRIPTION OF THE DRAWINGS

FIG. 10 is a diagram illustrating tonal representation according to the first embodiment;

FIG. 11 is a diagram illustrating smoothing according to the first embodiment;

FIG. 12 is a decode pattern diagram of the first embodiment;

BEST MODE FOR CARRYING OUT THE INVENTION

Below, the present invention is described with reference to a printer, a first embodiment and a second embodiment, in sequence.

[Printer]

Figure 1:
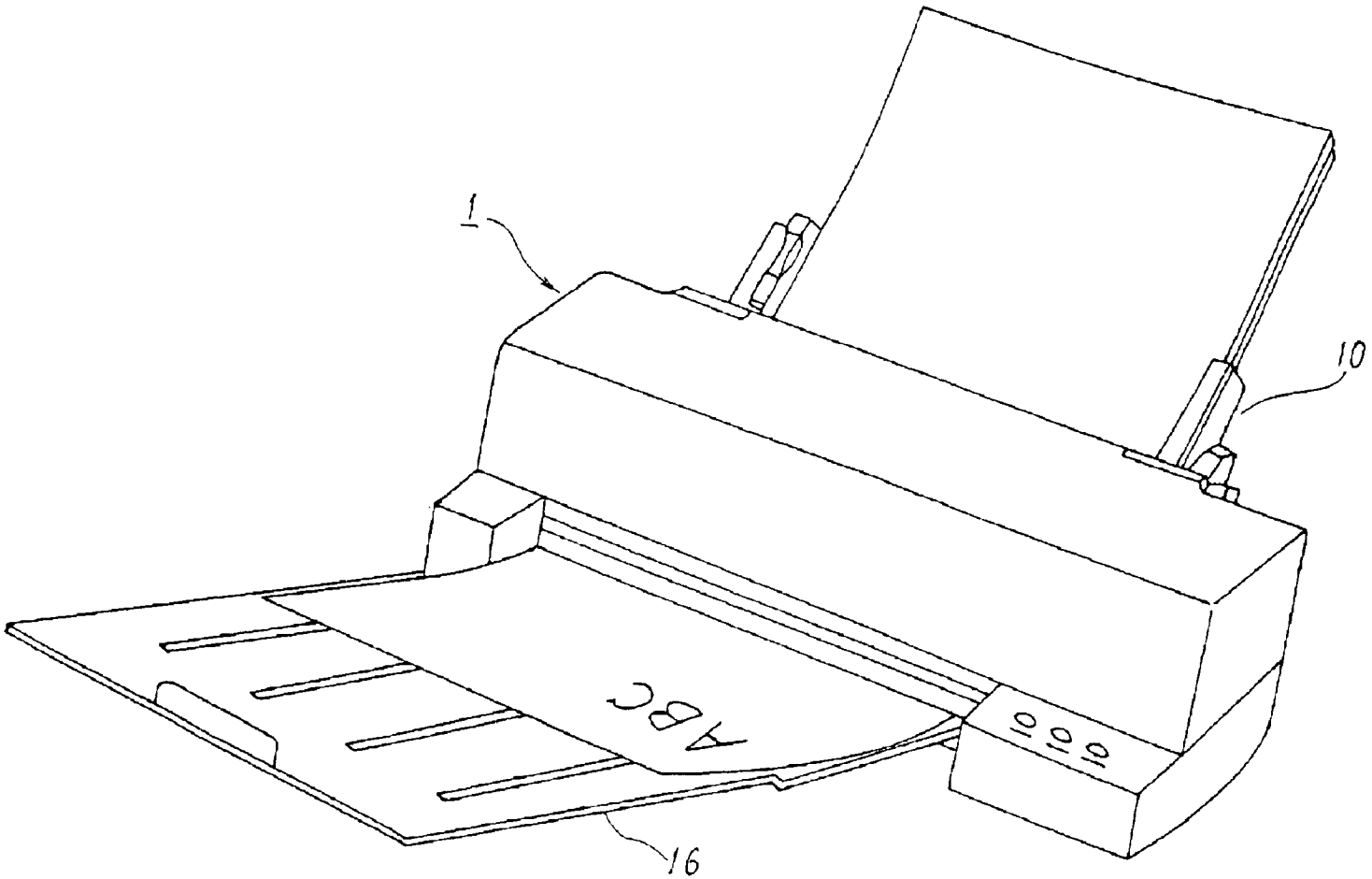
FIG. 1 is an oblique view of an inkjet printer according to one embodiment of the present invention.
Figure 2:
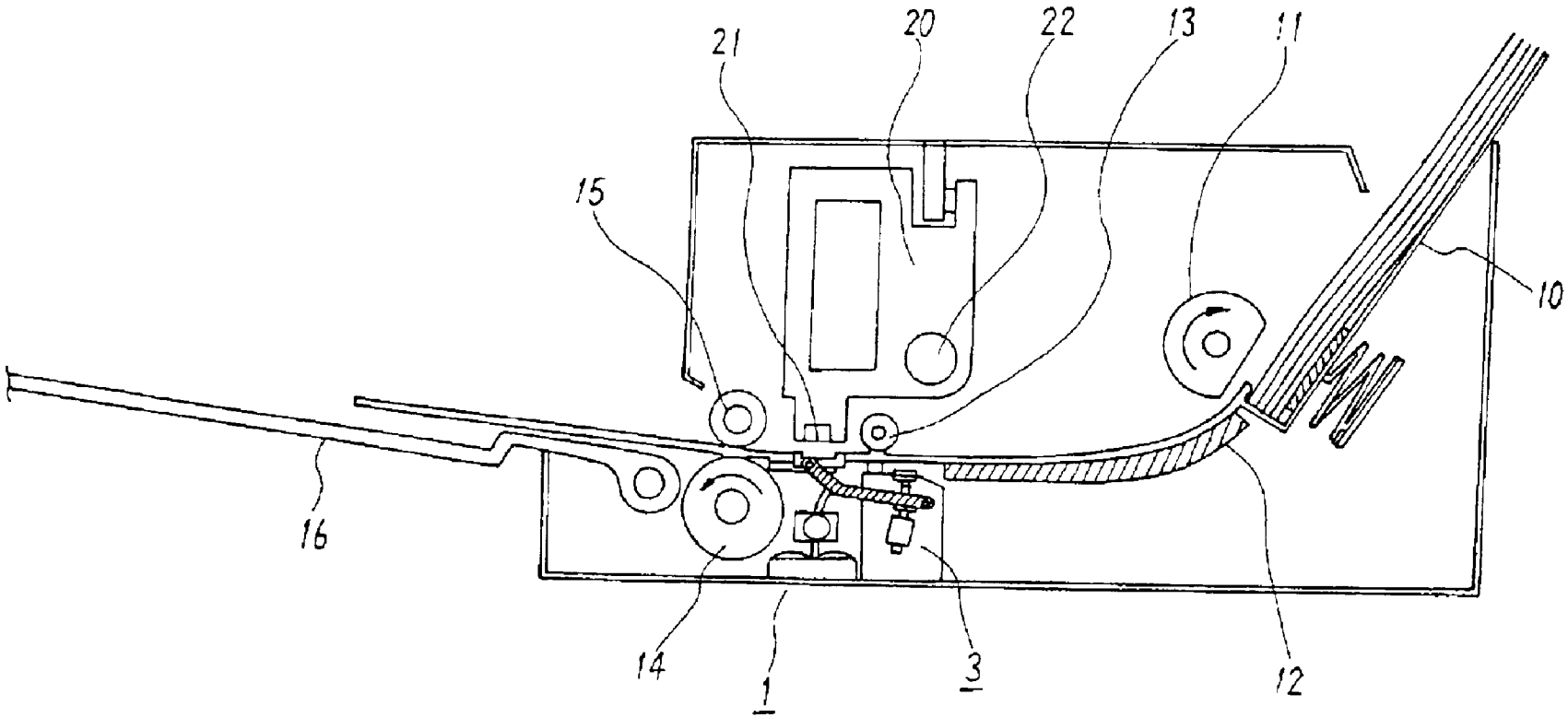
FIG. 2 is a sectional view of the inkjet printer in FIG. 1.
Figure 3:
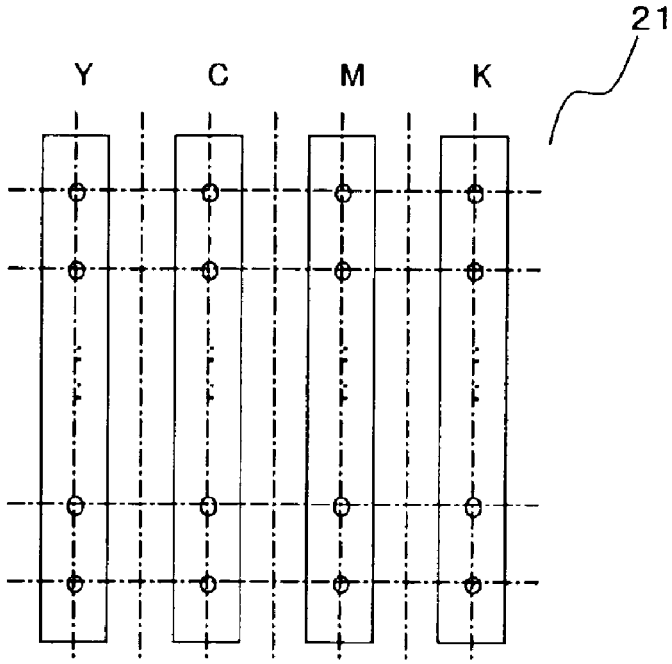
FIG. 3 is a front view of the inkjet head in FIG. 2.
Figure 4:
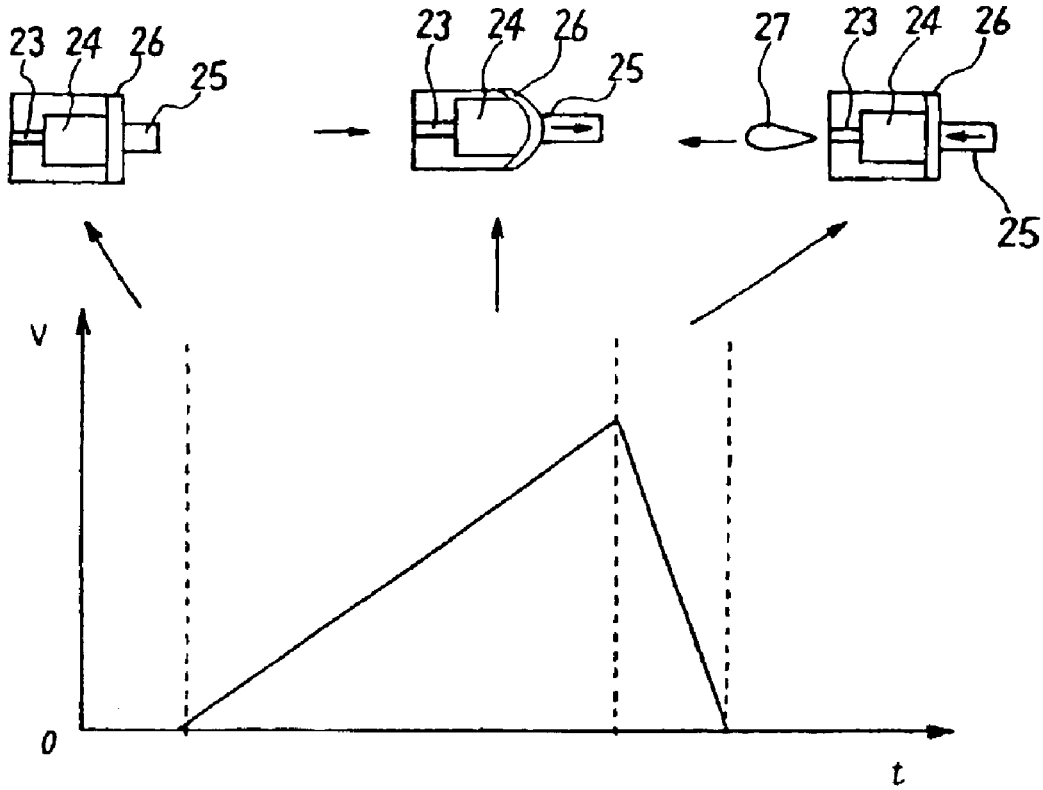
FIG. 4 is an explanatory diagram of the operation of the head in FIG. 3.
Figure 5:
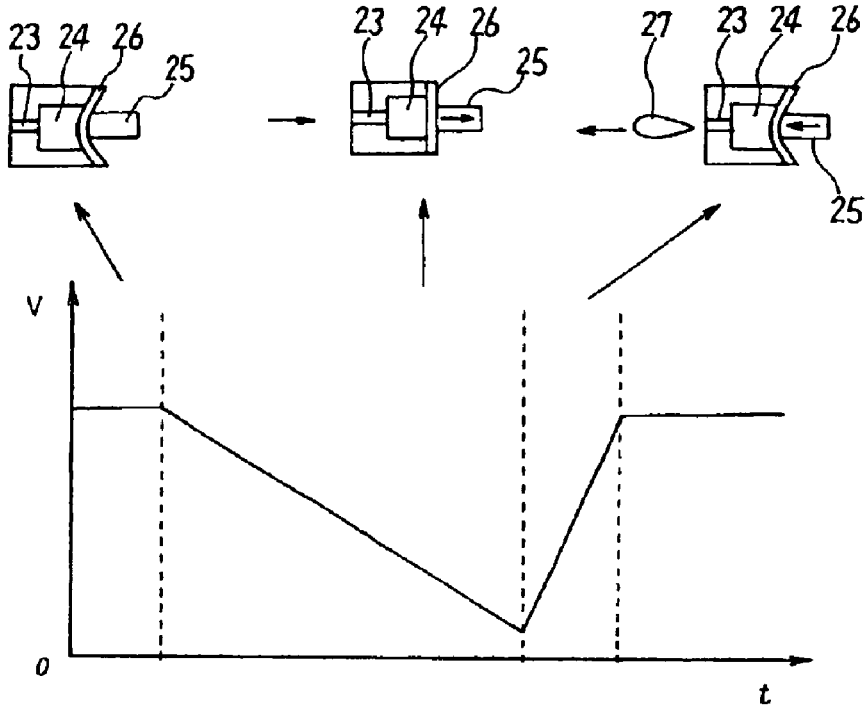
FIG. 5 is an explanatory diagram of a further drive mode of the head in FIG. 3.

FIG. 1 is an oblique view of a printer, FIG. 2 is a sectional view of the printer, FIG. 3 is a front view of an inkjet head, and FIG. 4 and FIG. 5 are explanatory diagrams of the operation of the head.

As shown in FIG. 1, the printer 1 takes up recording paper from a hopper 10, and after printing on it, ejects the paper to a stacker 16. As shown in FIG. 2, a feed roller 11 feeds the recording paper in the hopper 10 into the printer 1. The recording paper is then conveyed along the guide 12 in the direction of the carriage 20.

The carriage 20 is mounted with an inkjet head (hereinafter, called "head") 21, and moves in a main scanning direction of the paper (depth direction in the diagram), along a guide 22. The recording paper is pressed by a pressing roller 13 at the near side of the carriage 20, and is recorded onto by the head 21. The recording paper is pressed between a paper eject roller 14 and pressing roller 15, and is ejected thereby to the stacker 16. A cleaning mechanism 3 cleans the nozzles of the head 21.

As shown in FIG. 3, the head 21 comprises one row of nozzles of each of the colours, yellow (Y), cyan (C), magenta (M), and black (K). Each nozzle row comprises 24 nozzles, for example. As shown in FIG. 4, the operation of this head 21 involves applying a drive voltage to a piezoelectric element 25, thereby causing a vibrating plate 26 provided on the piezoelectric element 25 to deform. The vibrating plate 26 applies a pressure to the pressure chamber 24 and causes the ink in the nozzle 23 to retreat. When the drive voltage of the piezoelectric element 25 is returned to zero, the distortion of the piezoelectric element 25 ends, and hence the vibrating plate 26 returns to its previous position, the pressure in the pressure chamber 24 is released, and an ink particle 27 is emitted from the nozzle 23. Moreover, as shown in FIG. 5, if a drive voltage is applied in the opposite direction to FIG. 4, then ink is emitted in a similar manner.

In this embodiment, a piezoelectric type inkjet head is described, but it is also possible to use a head incorporating a thermal element.

[First Embodiment ]

Figure 6:
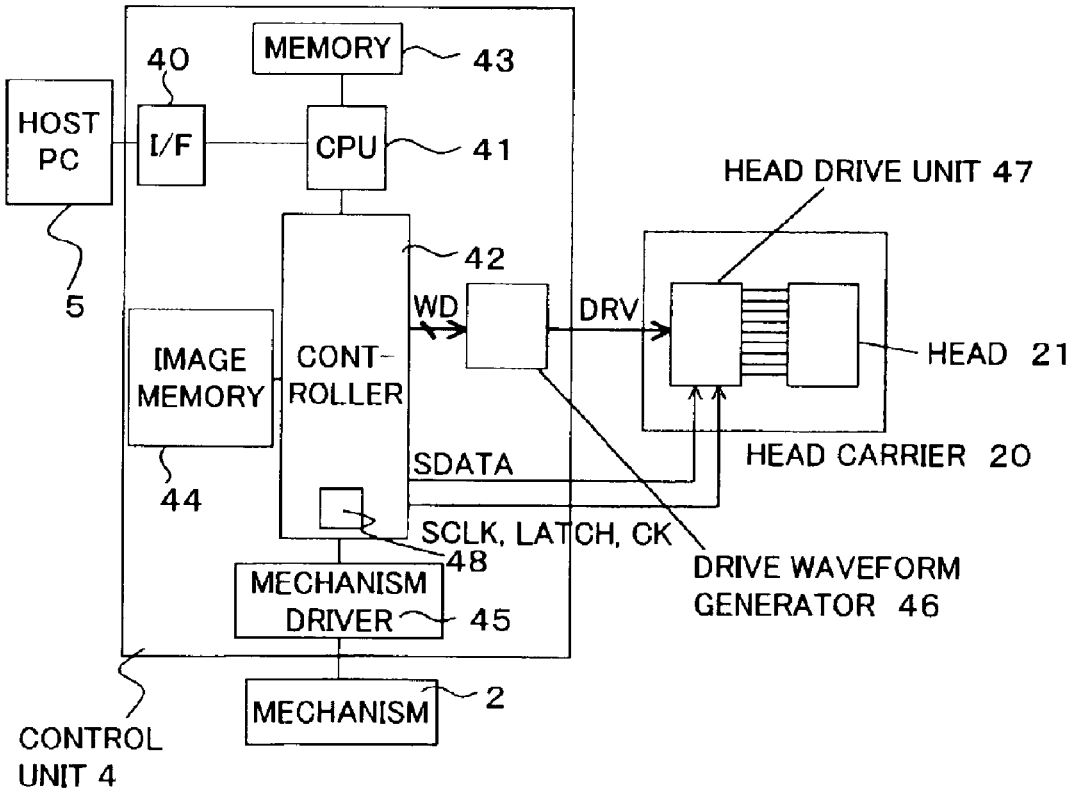
FIG. 6 is a circuit block diagram of a first embodiment of the present invention.
Figure 7:
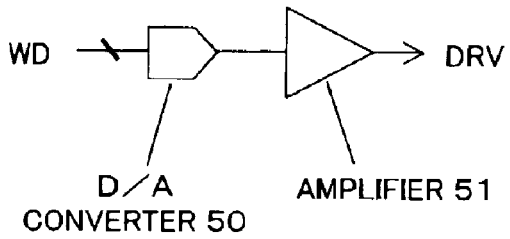
FIG. 7 is a compositional diagram of the drive waveform generating section in FIG. 6.
Figure 8:
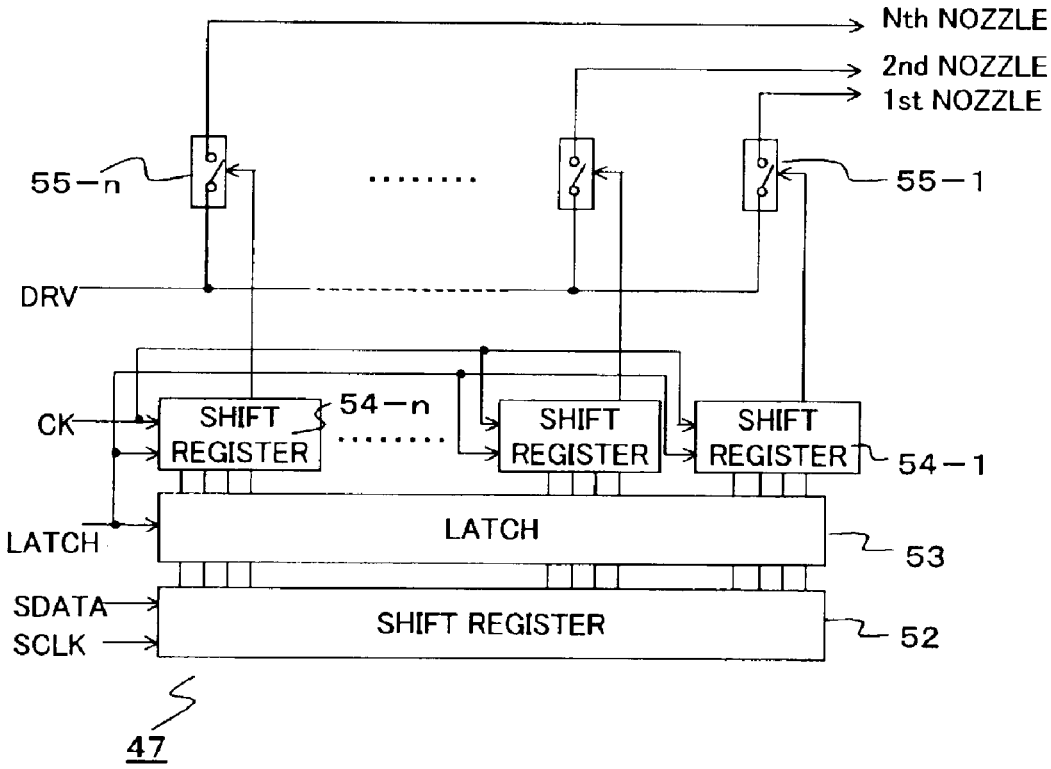
FIG. 8 is a compositional diagram of the head drive section in FIG. 6.
Figure 9:
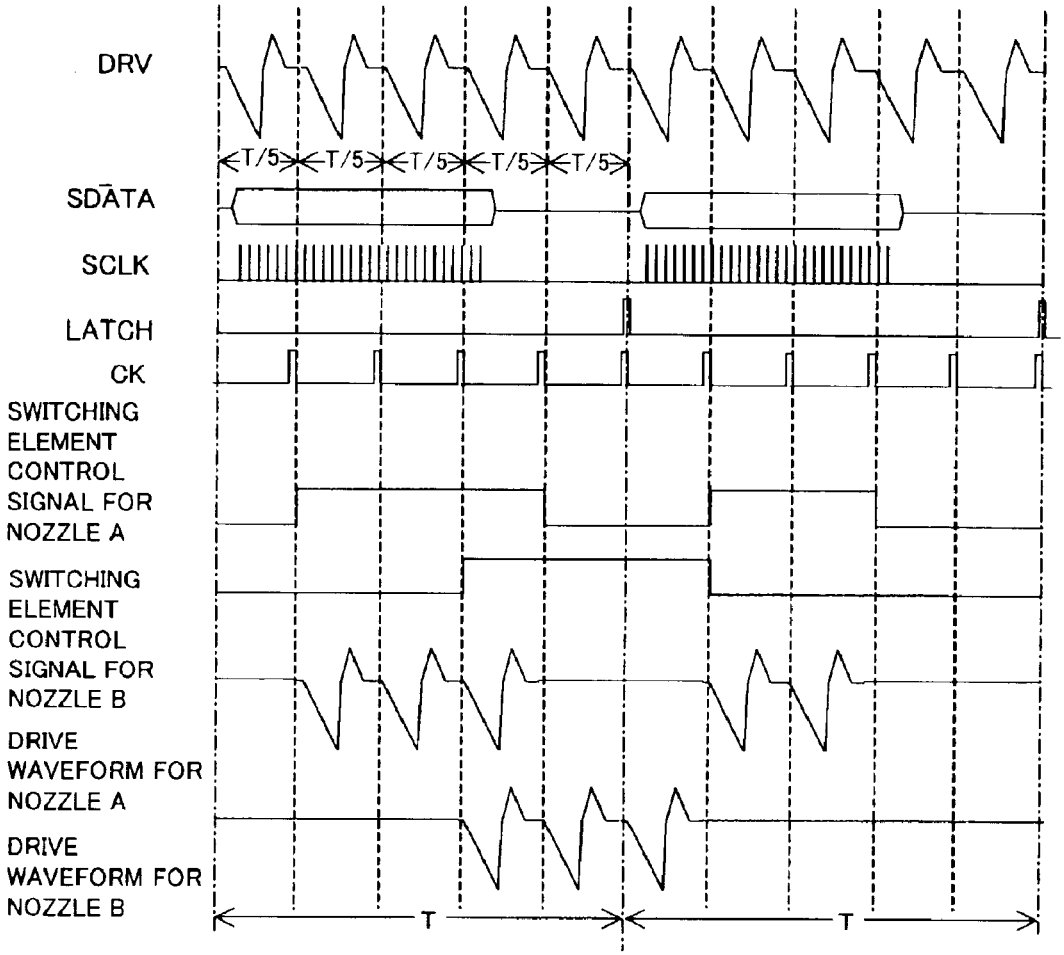
FIG. 9 is a time chart diagram of the composition of FIG. 6.
Figure 9:
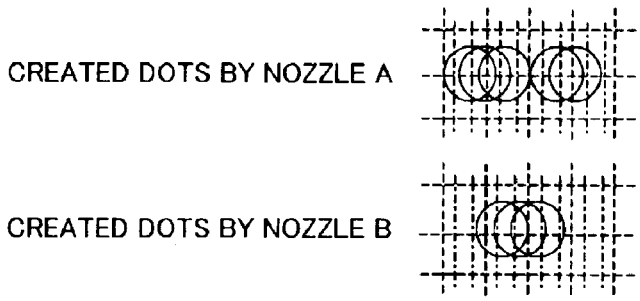

FIG. 6 is a circuit diagram of an inkjet printer according to a first embodiment of the present invention; FIG. 7 is a compositional diagram of a drive waveform generator unit; FIG. 8 is a compositional diagram of a head drive unit; and FIG. 9 is a timing chart of the composition in FIG. 6.

As shown in FIG. 6, the printer control circuit is constituted by a control unit 4, head unit 20, and mechanism 2 (see FIG. 2). The control unit 4 comprises an interface 40, CPU 41, memory 43, controller 42, image memory 44, mechanism driver 45, drive waveform generator unit 46, and the like.

The interface 40 serves to exchange commands and data with the host 5. The CPU 41 performs main control of the printer 1, using the memory 43. The image memory 44 stores image data that is to be printed. This image data consists of data for each pixels. The controller 42 generates drive signals of various types, according to instructions from the CPU 41, as described hereinafter.

The mechanism driver 45 drives the mechanism 2 according to instructions from the controller 42. The drive waveform generator unit 46 generates an analogue drive waveform DRV from a digital drive waveform WD from the controller 42. AS shown in FIG. 7, the drive waveform generator unit 46 is constituted in such a manner that it can generate any desired analogue waveform, and in the example in FIG. 7, the digital drive waveform data (WD) is converted to analogue data by the D/A converter 50, and amplified by the amplifier 51, to generate a head drive waveform (DRV). As described later in FIG. 9, the drive waveform generator unit 46 generates a head drive waveform (DRV) having a frequency which is an integral factor of the printing resolution (one pixel).

The head unit (head carrier) 20, on the other hand, is mounted with a head 21 and a head drive unit 47 for controlling same, and in addition to the aforementioned head drive waveform (DRV), control signals (SDATA, SCLK, LATCH, CK) based on the print signal are supplied to the head drive unit 47 by the controller 42. The composition of the head drive unit 47 is shown in FIG. 8.

Print data (SDATA), a shift clock (SCLK), latch (LATCH), subsidiary clock (CK), and the head drive waveform (DRV) are supplied to the inputs of the head drive unit 47, thereby causing the output-side switching elements 55-1 to 55-n to switch on and off, and controlling whether or not a head drive waveform (DRV) is supplied to the piezoelectric elements 25 corresponding to the respective nozzles of the head 21.

In other words, there are provided: a shift register 52 for shifting the print data (SDATA) by means of the shift clock (SCLK), a latch circuit 53 for latching the data from the shift register 52 by means of the latch (LATCH), and, provided with respect to each nozzle, shift registers 54-1 to 54-n for shifting the data for each nozzle by means of the subsidiary clock (CK) after it has been latched by the latch, and switching elements 55-1 to 55-n which are each input with the head drive waveform (DRV) and switched on and off by the output from the shift registers 54-1 to 54-n.

The operation is now explained with respect to FIG. 9. FIG. 9 is a timing chart for two cycles (a period in which each nozzle forms particles for two pixels). In this example, one pixel is constituted by a maximum of 5 ink particles. In other words, in the present invention, the cycle of the head drive waveform (DRV) is taken as 1/n with respect to the time period T for 1 pixel, in other words, one cycle of the print control signal (SDATA, SCLK, LATCH). In this example, the cycle of the head drive waveform is ⅕ with respect to the cycle of the print control signal. Each head drive waveform is an independent waveform capable of emitting ink from a nozzle, and having the same shape.

Therefore, the controller 42 outputs the head drive waveform data (WD) to the drive waveform generator unit 46 at a frequency of five times the print control signal. The head drive waveform data (WD) has been stored in a memory (not illustrated) within the controller 42, and the controller 42 reads out this waveform data at a frequency of five times the frequency of the print control signal, and outputs same to the drive waveform generator unit 46. The drive waveform generator unit 46 outputs an analogue drive waveform (DRV) having a cycle of T/5, as illustrated in FIG. 9.

This drive waveform (DRV) is input to the respective switches 55-1 to 55-n of the head drive unit 47. Here, it is assumed that the head 21 has n nozzles, and therefore, n switches 55-1 to 55-n are provided for independently driving the respective nozzles.

The print control signals (print data SDATA, SCLK, LATCH, CK) are generated by the controller 42. The system clock SCLK is supplied to shift register 52. The latch LATCH is generated at a cycle of the period T for one pixel, as shown in FIG. 9, and is supplied to the latch circuit 53 and sub shift register 54-1 to 54-n. The subsidiary clock CK is generated at a cycle of T/5 of the drive waveform described above, and is supplied to the subsidiary shift registers 54-1 to 54-n.

The controller 42 converts the image data in the image memory 44 to 5-bit print data for selecting a drive waveform (dot) in one of the aforementioned cycles. Therefore, it includes a decoder 48.

The input of the head drive unit 47 is supplied with the print data (SDATA), shift clock (SCLK), latch (LATCH), subsidiary clock (CK), and head drive waveform (DRV). The shift register 52 shifts the print data by the shift clock, and the latch circuit 53 latches the print data in the shift register 52. This print data is 5-bit print data for each nozzle.

The 5-bit print data is latched to the respective subsidiary shift registers 54-1 to 54-n. The 5-bit print data is shifted by the subsidiary clock CK, whereby the output-side switching elements 55-1 to 55-n are switched on and off, to control whether or not the head drive waveform (DRV) is supplied to the piezoelectric elements 25 corresponding to the respective nozzles of the head 21.

Therefore, the number of the five dots of the same size in one pixel, and the positions of the dots, can be controlled as desired. For example, in the case of nozzle A in FIG. 9, printing is performed and suitable tone representation is achieved as shown in the lower part of FIG. 9. In the case of nozzle B, a suitable smoothing representation is achieved, as shown in the lower part of FIG. 9.

A more detailed description is now given on the basis of FIG. 10 to FIG. 12. FIG. 10 illustrates tonal graduation according to the present invention, and it shows a six-stage tone example (including no print stage). In other words, since there are 5 dots per pixel, 6 stages of tones, from 0 to 5, based on numbers of dots are achieved. Here, a characteristic feature of this embodiment is that in each tone, the dot positioned in the centre of the pixel is always allocated, and then subsequent dots are allocated in the adjacent direction. Therefore, the decoder 48 of the controller 42 stores bit data corresponding to tone levels 0 to 5 as illustrated in FIG. 12, and bit data is selected according to the tone level of the image data. Thereby, since the surface area tone is created in the centre of the pixel, a satisfactory tone representation is achieved.

Moreover, FIG. 11 is an example wherein a smoothing process is implemented for smoothing and reducing the jagged portions of the edge portions of the image. Smoothing is performed on the original image in the left-hand image (binary image), by performing a data conversion as shown in the right-hand image. In this example, by converting the 1-bit data for each pixel to 5 bits, the emission timing for each ink particle is controlled and hence smoothing is achieved. In order to convert the data, the decoder 48 in FIG. 12 comprises a smoothing pattern table, which it references. The edge portion of the image is detected by a commonly known circuit, such as an edge detector section, or the like, which is not illustrated in the diagram.

A further merit of the present invention is that the landing positions of each small particle are slightly divergent, in comparison to the prior art method wherein they all land at the same position, and therefore problems caused by the ink reception capacity of the recording paper, such as blurring, print-through, or the like, are not liable to occur.

[Second Embodiment]

Figure 13:
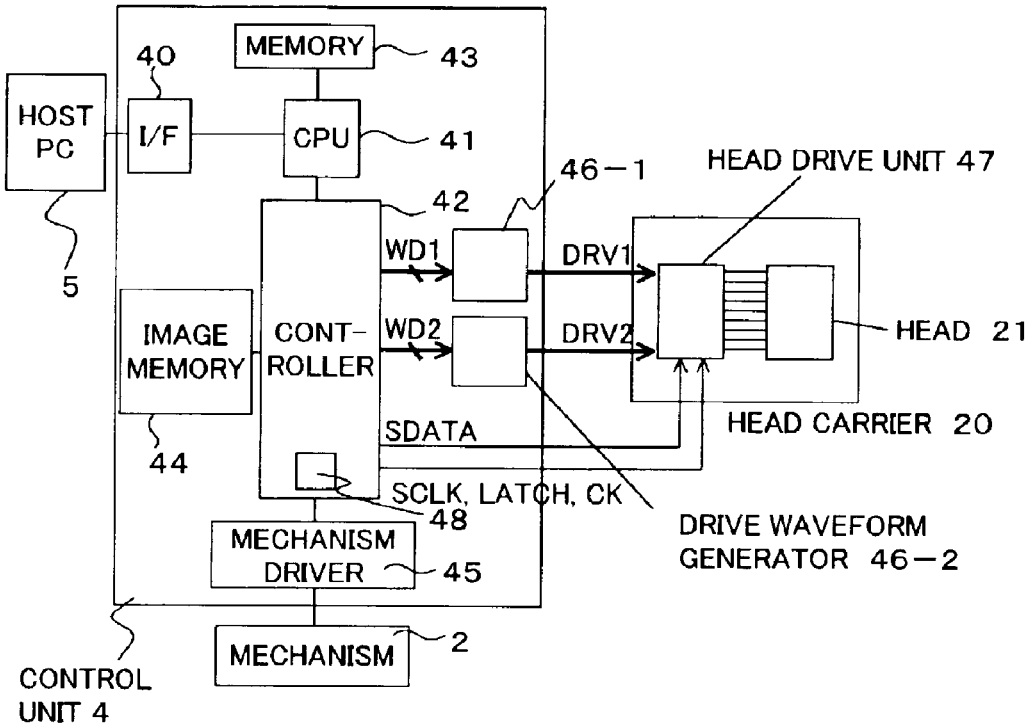
FIG. 13 is a circuit block diagram of a second embodiment of the present invention.
Figure 14:
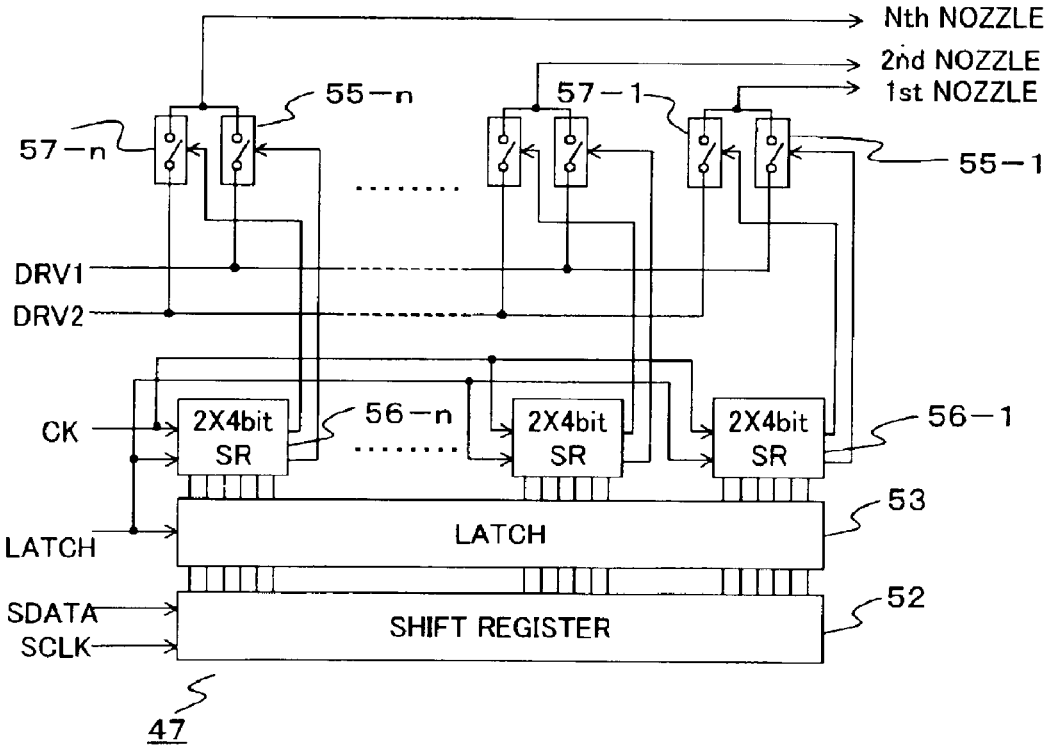
FIG. 14 is a compositional diagram of a head drive section in FIG. 13.
Figures 15, 16:
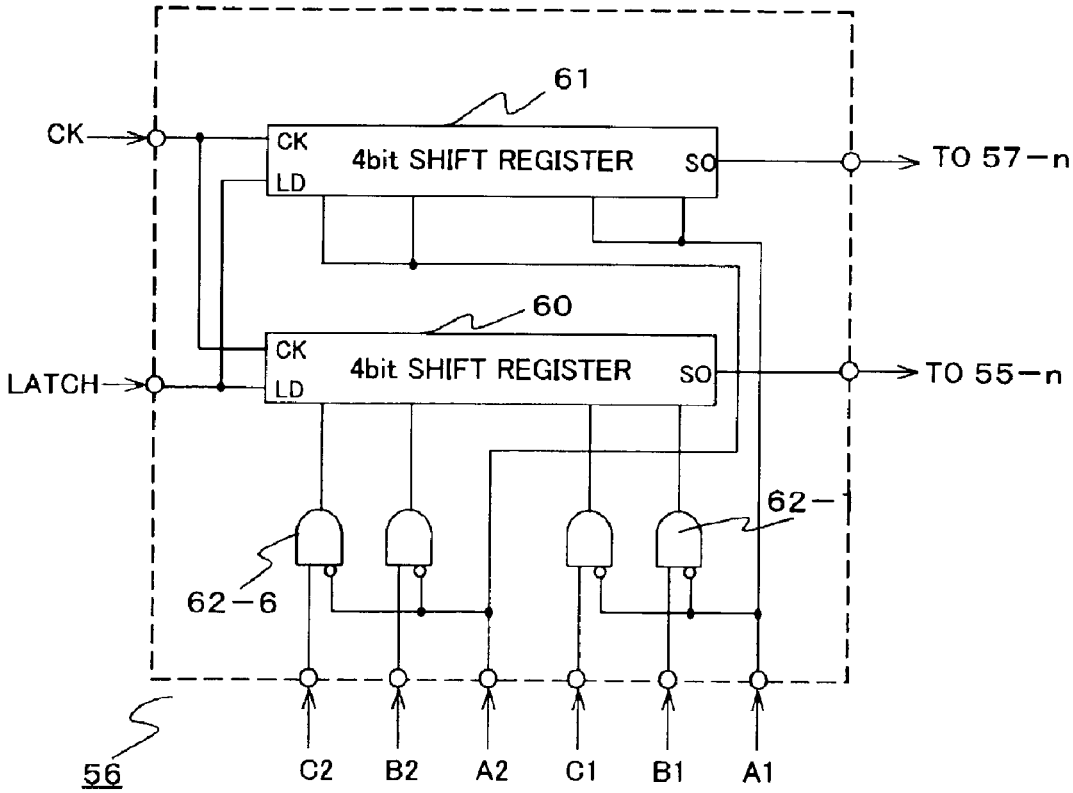
FIG. 15 is a compositional diagram of a 2×4 bit shift register in FIG. 14.
FIG. 16 is a decode pattern diagram according to a second embodiment.

FIG. 13 is a circuit diagram of an inkjet printer according to a second embodiment of the present invention; FIG. 14 is a compositional diagram of a head drive unit in FIG. 13; FIG. 15 is a compositional diagram of a subsidiary shift register; FIG. 16 is an explanatory diagram of a decoder; and FIG. 17 is a timing chart of the composition in FIG. 13.

In FIG. 13 and FIG. 14, elements which are the same as those in FIG. 6, FIG. 7 and FIG. 8 are similarly labelled. As shown in FIG. 13, the difference with respect to the first embodiment is that a plurality of drive waveform generator units 46-1 46-2 (in this case, two drive waveform generator units) are provided, in such a manner that a plurality of ink particles are generated by a plurality of head drive waveforms (DRV1, DRV2).

Figure 17:
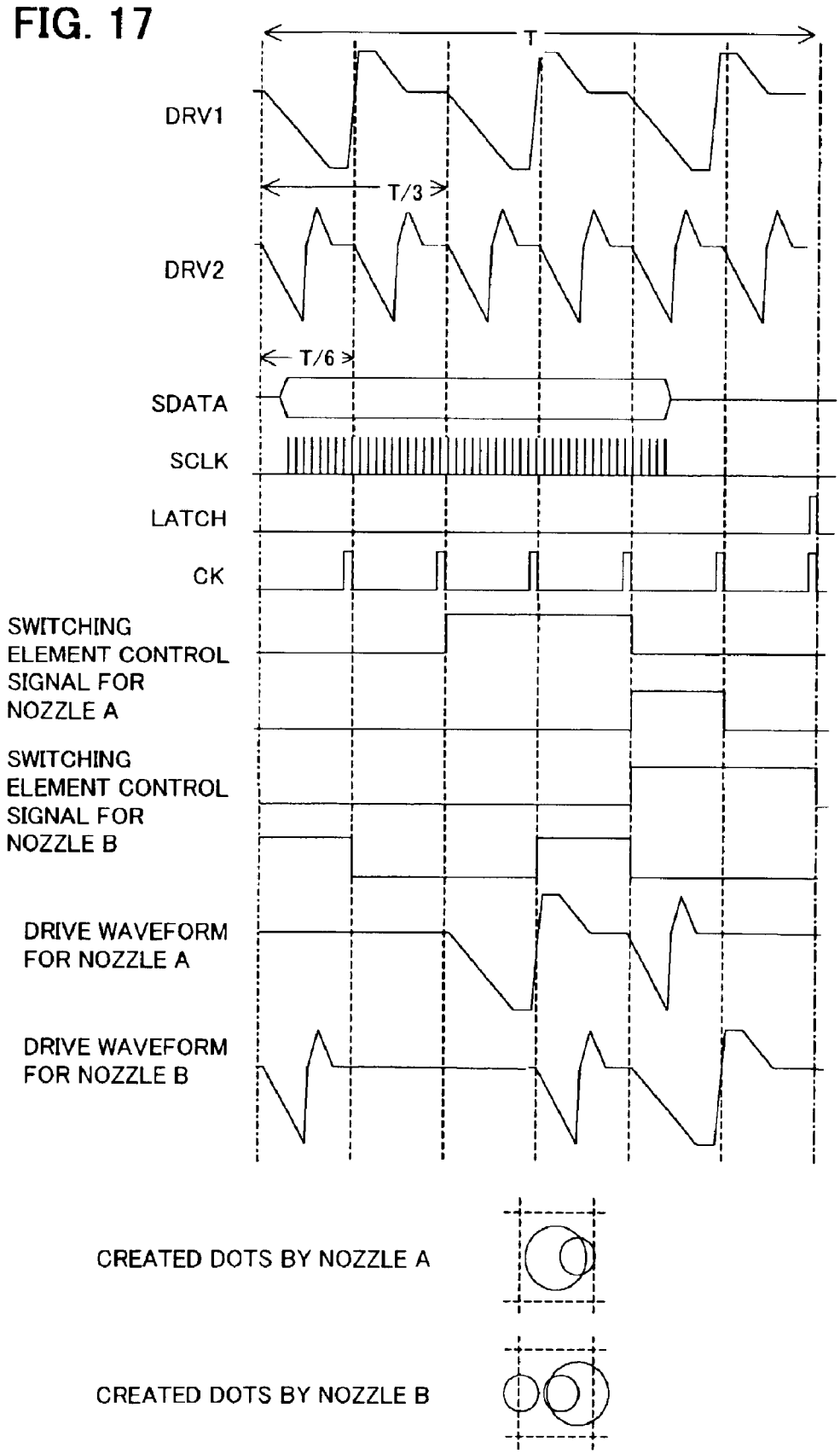
FIG. 17 is a time chart diagram of the composition in FIG. 13.

More specifically, as illustrated in FIG. 17, the first drive waveform generator unit 46-1 generates a first drive signal DRV1 for producing a relatively large ink particle, and the second drive waveform generator unit 46-2 generates a second drive signal DRV2 for producing a relatively small ink particle, as also illustrated in FIG. 17.

On the other hand, as illustrated in FIG. 14, the head drive unit 47 comprises: a shift register 52 for shifting print data (SDATA) by means of a shift clock (SCLK); a latch circuit 53 for latching the data in the shift register 52 by means of a latch (LATCH); and provided respectively for each nozzle, shift registers 56-1 to 56-n for shifting the data from respective nozzles by means of the subsidiary clock (CK), after it has been latched by the LATCH; first switching elements 55-1 to 55-n for respectively inputting a first head drive waveform (DRV1) and switching on/off according to the output of the shift registers 56-1 to 56-n; and second switching element 57-1 to 57-n for inputting a second head drive waveform (DRV2) and switching on/off according to output of the shift registers 56-1 to 56-n.

To describe the operation thereof, the print data (SDATA), shift clock (SCLK), latch (LATCH), dot clock (CK), head drive waveforms (DRV1, DRV2) are supplied to the input of the head drive unit 47, whereby the output-side switching elements 55-1 to 55-n, 57-1 to 57-n are switched on and off, and a head drive waveform (DRV1, DRV2) is selected and supplied to the piezoelectric element corresponding to each nozzle of the head.

FIG. 15 is a compositional diagram of the shift registers 56-1 to 56-n, being an example wherein each pixel is represented by 6 dots, and it comprises two 6-bit shift registers 60, 61 and gates 62-1 to 62-6. Normally, to constitute 6 dots by means of two ink particles of different sizes, it is necessary to provide 12-bit data, but as illustrated in FIG. 16, here, 9-bit data is used and hence a saving in print data is achieved. For this purpose, the 9-bit data is converted by the gates 62-1 to 62-6, from 9-bit data to 12-bit data.

The operation is described in FIG. 17, which shows a timing chart of one cycle (the period in which each nozzle forms particles for one pixel). In this example, one pixel is constituted by a maximum of 6 ink particles. In other words, the cycle of the head drive waveform (DRV1) is ⅓, and the cycle of DRV2 is ⅙, with respect to one cycle of the print control signals (SDATA, SCLK, LATCH). The head drive waveforms are independent waveforms capable of emitting ink from a nozzle, and having the same shape.

Therefore, the controller 42 outputs the head drive waveform data (WD1, WD2) to the drive waveform generator units 46-1, 46-2. The head drive waveform data (WD) has been stored in a memory (not illustrated) within the controller 42, therefore the controller 42 reads out this waveform data at a frequency of six times the frequency of the print control signal, and outputs same to the drive waveform generator units 46-1, 46-2. The drive waveform generator units 46-1, 46-2 output an analogue drive waveforms (DRV1, DRV2) having a cycle of T/6 as illustrated in FIG. 17.

These drive waveforms (DRV1, DRV2) are input to the respective switches 55-1 to 55-n, 57-1 to 57-n of the head drive section 47. The print control signals (print data SDATA, SCLK, LATCH, CK), on the other hand, are generated by the controller 42. The system clock SCLK is supplied to shift register 52. The latch LATCH is generated at a cycle of the period T for one pixel, as shown in FIG. 9, and is supplied to the latch circuit 53 and sub shift registers 54-1 to 54-n. The subsidiary clock CK is generated at a cycle of T/6 of the drive waveforms described above, and is supplied to the subsidiary shift registers 56-1 to 56-n.

The controller 42 converts the image data in the image memory 44 to 9-bit print data for selecting a drive waveform (dot) in one of the aforementioned cycles. Therefore, it includes a decoder 48.

The input of the head drive unit 47 is supplied with the print data (SDATA), shift clock (SCLK), latch (LATCH), subsidiary clock (CK), and head drive waveforms (DRV1, DRV2). The shift register 52 shifts the print data by means of the shift clock, and the latch circuit 53 latches the print data in the shift registers 52. This print data is 9-bit print data for each nozzle.

The 9-bit print data is latched to the respective subsidiary shift registers 60, 61. The 6-bit print data is shifted by the subsidiary clock CK, whereby the output-side switching elements 55-1 to 55-n, 57-1 to 57-n are switched on and off, to control whether or not the head drive waveforms (DRV1, DRV2) are supplied to the piezoelectric elements 25 corresponding to the respective nozzles of the head 21.

For this purpose, the number of six dots in one pixel, and the position and size of the dots, can be controlled as desired.

For example, in the example of the nozzle A in FIG. 17, printing is performed and suitable tonal representation is achieved as shown in the lower part of FIG. 17. Moreover, in the example of the nozzle B, suitable smoothing representation is achieved as shown in the lower part of FIG. 17.

Figure 18:
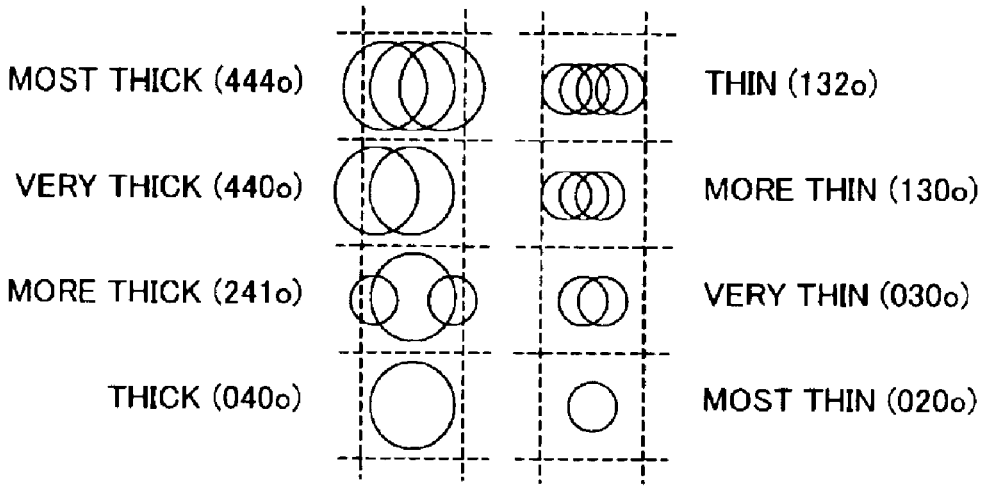
FIG. 18 is a diagram showing tonal representation according to a second embodiment.
Figure 19:
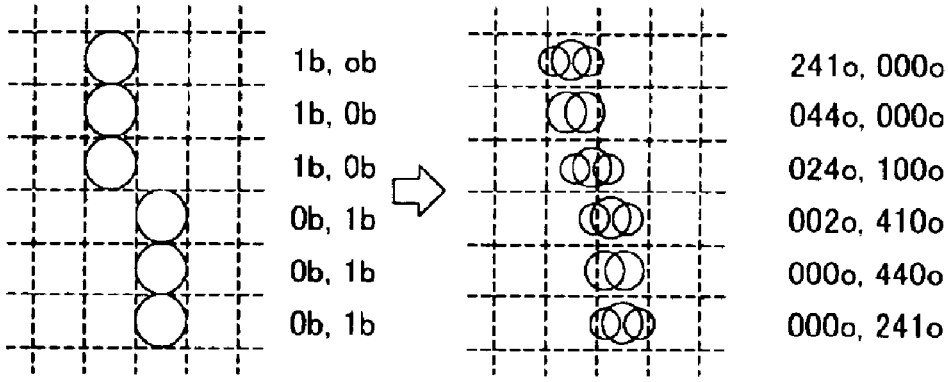
FIG. 19 is a diagram showing smoothing according to a second embodiment.
Figure 20:
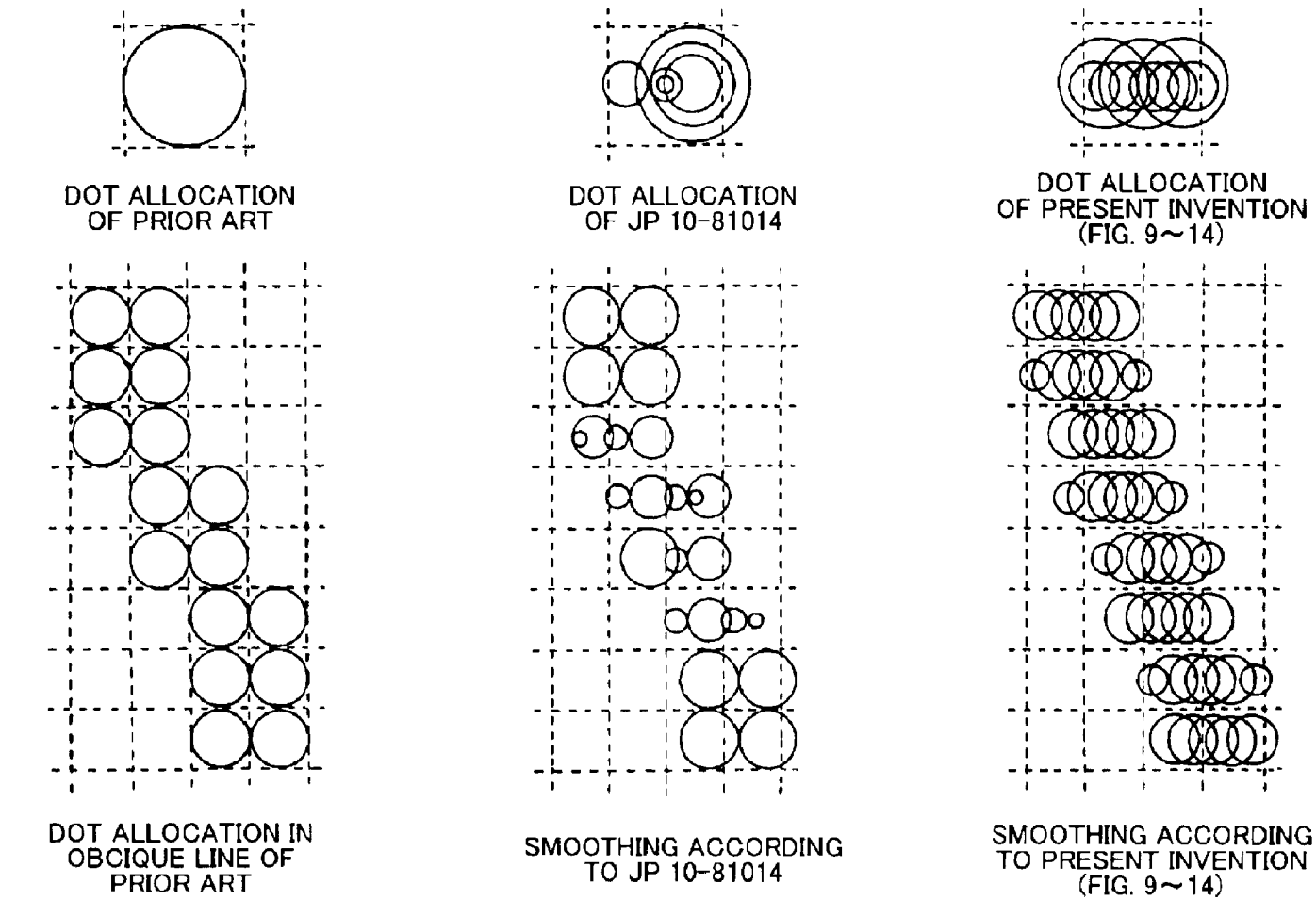
FIG. 20 is a diagram illustrating the effects of smoothing according to a second embodiment.

A more detailed description is now given on the basis of FIG. 18 to FIG. 20. FIG. 18 illustrates tonal graduation according to the present invention, and it shows a nine-stage tone example (including no print stage). In other words, since there are 6 dots per pixel and two types of ink particle, 9 stages of tones, from 0 to 8, based on the number of dots are achieved. Here, a characteristic feature of this embodiment is that in each tone, the dot positioned in the centre of the pixel is always allocated, and then subsequent dots are allocated in the adjacent direction. Therefore, the decoder 48 of the controller 42 stores bit data corresponding to tone levels 0 to 8 as illustrated in FIG. 16, and bit data is selected according to the tone level of the image data. Thereby, since the surface area tone is created in the centre of the pixel, a satisfactory tone representation is achieved.

Moreover, FIG. 19 is an example wherein a smoothing process is implemented for smoothing and reducing the jagged portions of the edge portions of the image. Smoothing is performed on the original image in the left-hand image (binary image), by performing a data conversion as shown in the right-hand image. In this example, by converting the 1-bit data for each pixel to 9 bits, the emission timing for each ink particle is controlled and hence smoothing is achieved. In order to convert the data, the decoder 48 in FIG. 16 comprises a smoothing pattern table, which it references. The edge portion of the image is detected by a commonly known circuit, such as an edge detector section, or the like, which is not illustrated in the diagram.

By performing tonal representation for each pixel by means of the inkjet printer having the foregoing composition, the size, number and combination of ink particles in each pixel is varied, and hence tones can be represented. Since the size can be varied to a greater degree than in the first embodiment, the variety of possible combinations increases, and hence the number of tones can also be increased.

Moreover, FIG. 20 is an example wherein smoothing is carried out. This smoothing is performed by data conversion of the original image (binary) on the left-hand side of the diagram, so that it appears as in the right-hand diagram. In this example, the smoothing is achieved by converting the 1-bit data for each pixel to 6-bit data, thereby controlling the size and emission timing of each ink particle. Moreover, shown in the centre of the diagram is an example of conventional smoothing (for example, Japanese Patent Laid-open No. 0-81014) wherein dots of different sizes are located in different positions. It can be seen that a more smooth smoothing effect is achieved in the case of the present invention.

In the first embodiment, small dots are simply placed alongside each other, and therefore a problem arises in that it becomes difficult to link upper and lower dots and a space is liable to occur therebetween, but in the present embodiment, this problem can be resolved by combined use of large dots also. Moreover, compared to conventional methods comprising waveform generator sections for each tone graduation, here, it is possible to represent the same number of tones by means of a smaller number of circuits.

INDUSTRIAL APPLICABILITY

In order to adjust the head drive frequency and head carrier movement speed in such a manner that adjacent dots of the same size are caused to overlap by one half or more within one pixel, the cycle of the drive waveform (DRV) is taken as an integral fraction of one cycle of the print control signals (for one pixel). By adopting this control method, one cycle of the print control signals, or namely, one pixel, can be represented by a plurality of dots of the same size. Moreover, each nozzle is switched on and off at desired times within one cycle of the print control signals, in accordance with the print data, and hence the positions of individual dots within one pixel can be shifted independently. Thereby, tones and smoothing can be represented suitably, by means of a small number of different drive waveforms.

What is claimed is:

1. An on-demand inkjet printer comprising:

an inkjet head which moves in the main scanning direction of a recording medium;

a drive waveform generator unit for generating a drive waveform for emitting an ink particle to form dots of a same size, in a cycle that is 1/n of the cycle for one pixel, with one pixel including a maximum number of n ink particles;

a print data generator unit for generating print data of a plurality of bits for selecting said drive waveform within the cycle for one pixel; and a head drive unit for driving the nozzles of said head, by selecting said drive waveform in accordance with said print data, wherein said print data generator unit includes a decoder for generating print data corresponding to a smoothing pattern, and wherein the decoder comprises a pattern table, to which it refers, for converting the data in order to perform smoothing by controlling the emission timing for each ink particle.

2. The on-demand inkjet printer according to claim 1, wherein said head drive unit comprises:

switches for selecting said drive waveform; and shift registers for operating said switches, by shifting said print data within said cycle for one pixel.

3. The on-demand inkjet printer according to claim 1, wherein said print data generator unit generates print data in such a manner that the dots selected within said cycle for one pixel are continuous.

4. The on-demand inkjet printer according to claim 3, wherein the decoder is for generating print data corresponding to a tone level for said one pixel.

5. The on-demand inkjet printer according to claim 1, wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive waveform for emitting ink particles to form dots of a second same size within a cycle that is an integral fraction of the cycle for one pixel; and wherein said head drive unit comprises a drive unit for driving the nozzles of said head by selecting either said first drive waveform or said second drive waveform, in accordance with said print data.

6. A drive device for an inkjet head moving in a main scanning direction of a recording medium, comprising:

a drive waveform generator unit for generating a drive waveform for emitting an ink particle to form dots of a same size in a cycle that is 1/n of the cycle for one pixel, with one pixel including a maximum number of n ink particles;

a print data generator unit for generating print data of a plurality of bits for selecting said drive waveforms in the cycle for one pixel; and a head drive unit for driving the nozzles of said head, by selecting said drive waveform in accordance with said print data, wherein said print data generator unit includes a decoder for generating print data corresponding to a smoothing pattern, and wherein the decoder comprises a pattern table, to which it refers, for converting the data in order to perform smoothing by controlling the emission timing for each ink particle.

7. The drive device for an inkjet head according to claim 6, wherein said head drive unit comprises:

switches for selecting said drive waveform; and shift registers for operating said switches, by shifting said print data within said cycle for one pixel.

8. The drive device for an inkjet head according to claim 6, wherein said print data generator unit generates print data in such a manner that the dots selected within said cycle for one pixel are continuous.

9. The drive device for an inkjet head according to claim 8, wherein the decoder is for generating print data corresponding to a tone level for said one pixel.

10. The drive device for an inkjet head according to claim 6, wherein said drive waveform generator unit comprises:

a first drive waveform generator unit for generating a first drive waveform for emitting a ink particle to form dots of a first same size within a cycle that is an integral fraction of the cycle for one pixel; and a second drive waveform generator unit for generating a second drive waveform for emitting a ink particle to form dots of a second same size within a cycle that is an integral fraction of the cycle for one pixel;

and wherein said head drive unit comprises a drive unit for driving the nozzles of said head by selecting either said first drive waveform or said second drive waveform in accordance with said print data.

11. A drive method for an inkjet head moving in a main scanning direction of a recording medium, comprising:

a drive waveform generating step for generating a drive waveform for emitting an ink particle to form dots of a same size in a cycle that is 1/n of the cycle for one pixel, with one pixel including a maximum number of n ink particles;

a print data generating step for generating print data of a plurality of bits for selecting said drive waveform in said cycle for one pixel; and a head driving step for driving the nozzles of said head, by selecting said drive waveform in accordance with said print data.

wherein said print data generator unit includes a decoder for generating print data corresponding to a smoothing pattern, and wherein the decoder comprises a pattern table, to which it refers, for converting the data in order to perform smoothing by controlling the emission timing for each ink particle.

12. The drive method for an inkjet head according to claim 11, wherein said head drive step comprises a step for selecting said drive waveform by shifting said print data within said cycle for one pixel.

13. The drive method for an inkjet head according to claim 11, wherein said print data generating step comprises a step for generating print data in such a manner that the dots selected within said cycle for one pixel are continuous.

14. The drive method for an inkjet head according to claim 13, wherein said print data generating step comprises a step for generating print data corresponding to a tone level for said one pixel and generating print data corresponding to a smoothing pattern.

15. The drive method for an inkjet head according to claim 11, wherein said drive waveform generating step comprises a step for generating a first drive waveform for emitting a ink particle to form dots of a first same size within a cycle that is an integral fraction of the cycle for one pixel, and a second drive waveform for emitting a ink particle to form dots of a second same size within a cycle that is an integral fraction of the cycle for one pixel;

and wherein said head driving step comprises a driving step for driving the nozzles of said head by selecting either said first drive waveform or said second drive waveform, in accordance with said print data.

16. An on-demand inkjet printer comprising:

an inkjet head which moves in the main scanning direction of a recording medium;

a drive waveform generator unit for generating a drive waveform for emitting a ink particle to form dots of a same size, in a cycle that is an integral fraction of the cycle for one pixel;

a print data generator unit for generating print data of a plurality of bits for selecting said drive waveform within the cycle for one pixel; and a head drive unit for driving the nozzles of said head, by selecting said drive waveform in accordance with said print data, wherein said print data generator unit generates print data in such a manner that the dots selected within said cycle for one pixel are continuous, wherein said print data generator unit includes a decoder for generating print data corresponding to a tone level for said one pixel and generating print data corresponding to a smoothing pattern, and wherein the decoder comprises a pattern table, to which it refers, for converting the data in is order to perform smoothing by controlling the emission timing for each ink particle, and the decoder performs smoothing by shifting the positions of individual dots within one pixel at each nozzle.

17. An on-demand inkjet printer comprising:

an inkjet head which moves in the main scanning direction of a recording medium;

a drive waveform generator unit for generating a drive waveform for emitting a ink particle to form dots of a same size, in a cycle that is an integral fraction of the cycle for one pixel;

a print data generator unit for generating print data of a plurality of bits for selecting said drive waveform within the cycle for one pixel; and a head drive unit for driving the nozzles of said head, by selecting said drive waveform in accordance with said print data, wherein said print data generator unit generates print data in such a manner that the dots selected within said cycle for one pixel are continuous, wherein said print data generator unit includes a decoder for generating print data corresponding to a tone level for said one pixel and generating print data corresponding to a smoothing pattern, wherein, in each tone, the dot positioned in the center of the pixel is always allocated, and is then subsequent dots are allocated in the adjacent direction, and thereby, the surface area tone is created in the center of the pixel, and wherein the decoder comprises a pattern table, to which it refers, for converting the data in order to perform smoothing by controlling the emission timing for each ink particle.

18. A drive device for an inkjet head moving in a main scanning direction of a recording medium, comprising:

a drive waveform generator unit for generating a drive waveform for emitting a ink particle to form dots of a same size in a cycle that is an integral fraction of the cycle for one pixel;

a print data generator unit for generating print data of a plurality of bit for selecting said drive waveforms in the cycle for one pixel; and a head drive unit for driving the nozzles of said head, by selecting said drive waveform in accordance with said print data, wherein said print data generator unit generates print data in such a manner that the dots selected within said cycle for one pixel are continuous, wherein said print data generator unit includes a decoder for generating print data corresponding to a tone level for said one pixel and generating print data corresponding to a smoothing pattern, and wherein the decoder comprises a pattern table, to which it refers, for converting the data in order to perform smoothing by controlling the emission timing for each ink particle, and the decoder performs smoothing by shifting the positions of individual dots within one pixel at each nozzle.

19. A drive device for an inkjet head moving in a main scanning direction of a recording medium, comprising:

a drive waveform generator unit for generating a drive waveform for emitting a ink particle to form dots of a same size in a cycle that is an integral fraction of the cycle for one pixel;

a print data generator unit for generating print data of a plurality of bits for selecting said drive waveforms in the cycle for one pixel; and a head drive unit for driving the nozzles of said head, by selecting said drive waveform in accordance with said print data, wherein said print data generator unit generates print data in such a manner that the dots selected within said cycle for one pixel are continuous, wherein said print data generator unit includes a decoder for generating print data corresponding to a tone level for said one pixel and generating print data corresponding to a smoothing pattern, wherein, in each tone, the dot positioned in the center of the pixel is always allocated, and then subsequent dots are allocated in the adjacent direction, and thereby, the surface area tone is created in the center of the pixel, and wherein the decoder comprises a pattern table, to which it refers, for converting the data in order to perform smoothing by controlling the emission timing for each ink particle.

20. A drive method for an inkjet head moving in a main scanning direction of a recording medium, comprising:

a drive waveform generating step for generating a drive waveform for emitting a ink particle to form dots of a same size in a cycle that is an integral fraction of the cycle for one pixel;

a print data generating step for generating print data of a plurality of bit for selecting said drive waveform in said cycle for one pixel; and a head driving step for driving the nozzles of said head, by selecting said drive waveform in accordance with said print data, wherein said print data generating step comprises a step for generating print data in such a manner that the dots selected within said cycle for one pixel are continuous, wherein said print data generating step comprises a step for generating print data corresponding to a tone level for said one pixel and generating print data corresponding to a smoothing pattern, and wherein a decoder comprises a pattern table, to which it refers, for converting the data in order to perform smoothing by controlling the emission timing for each ink particle, and the decoder performs smoothing by shifting the positions of individual dots within one pixel at each nozzle.

21. A drive method for an inkjet head moving in a main scanning direction of a recording medium, comprising:

a drive waveform generating step for generating a drive waveform for emitting a ink particle to form dots of a same size in a cycle that is an integral fraction of the cycle for one pixel;

a print data generating step for generating print data of a plurality of bits or selecting said drive waveform in said cycle for one pixel; and a head driving step for driving the nozzles of said head, by selecting said drive waveform in accordance with said print data, wherein said print data generating step comprises a step for generating print data in such a manner that the dots selected within said cycle for one pixel are continuous, wherein said print data generating step comprises a step for generating print data corresponding to a tone level for said one pixel and generating print data corresponding to a smoothing pattern, wherein, in each tone, the dot positioned in the center of the pixel is always allocated, and then subsequent dots are allocated in the adjacent direction, and thereby, the surface area tone is created in the center of the pixel, and wherein said print data generating step comprises a step for referring to pattern table for converting the data in order to perform smoothing by controlling the emission timing for each ink particle.

22. An on-demand inkjet printer comprising:

an inkjet head which moves in the main scanning direction of a recording medium;

a drive waveform generator unit for generating a drive waveform for emitting a ink particle to form dots of a same size, in a cycle that is an integral fraction of the cycle for one pixel;

a print data generator unit for generating print data of a plurality of bits or selecting said drive waveform within the cycle for one pixel; and a head drive unit for driving the nozzles of said head, by selecting said drive waveform in accordance with said print data, wherein said drive waveform generator unit comprises:

a first drive waveform generator unit for generating a first drive waveform for emitting ink particles to form dots of a first same size within a cycle at is an integral fraction of the cycle for one pixel; and a second drive waveform generator unit for generating a second drive waveform for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform, in accordance with said print data, wherein the adjacent dots of the same size are caused to overlap by one half or more within one pixel, and a tonal representation is performed by making the combination of the size and the number of the dots in each pixel variable, wherein said print data generator unit includes a decoder for generating print data corresponding to a smoothing pattern, and wherein the decoder comprises a pattern table, to which it refers, for converting the data in order to perform smoothing by controlling the emission timing for each ink particle.

23. A drive device for an inkjet head moving in a main scanning direction of a recording medium, comprising:

a drive waveform generator unit for generating a drive waveform for emitting a ink particle to form dots of a same size in a cycle that is an integral fraction of the cycle for one pixel;

a print data generator unit for generating print data of a plurality of bits for selecting said drive waveforms in the cycle for one pixel; and a head drive unit for driving the nozzles of said head, by selecting said drive waveform in accordance with said print data, wherein said drive waveform generator unit comprises:

a first drive waveform generator unit for generating a first drive waveform for emitting a ink particle to form dots of a first same size within a cycle at is an integral fraction of the cycle for one pixel; and a second drive waveform generator unit for generating a second drive waveform for emitting a ink particle to form dots of a second same size within a cycle that is an integral fraction of the cycle for one pixel;

wherein said head drive unit comprises a drive unit for driving the nozzles of said head by selecting either said first drive waveform or said second drive waveform in accordance with said print data, wherein the adjacent dots of the same size are caused to overlap by one half for more within one pixel, and a tonal representation is performed by making the combination of the size and the number of the dots in each pixel variable, wherein said print data generator unit includes a decoder for generating print data corresponding to a smoothing pattern, and wherein the decoder comprises a pattern table, to which it refers, for converting the data in order to perform smoothing by controlling the emission timing for each ink particle.

24. A drive method for an inkjet head moving in a main scanning direction of a recording medium, comprising:

a drive waveform generating step for generating a drive waveform for emitting a ink particle to form dots of a same size in a cycle that is an integral fraction of the cycle for one pixel;

a print data generating step for generating print data of a plurality of bits for selecting said drive waveform in said cycle for one pixel; and a head driving step for driving the nozzles of said head, by selecting said rive waveform in accordance with said print data, wherein said drive waveform generating step comprises a step for generating a first drive waveform for emitting a ink particle to form dots of a first same size within a cycle that is an integral fraction of the cycle for one pixel, and a second drive waveform for emitting a ink particle to form dots of a second same size within a cycle that is an integral fraction of the cycle or one pixel;

wherein said head driving step comprises a driving step for driving the nozzles of said head by selecting either said first drive waveform or said second drive waveform, in accordance with said print data, wherein the adjacent dots of the same size are caused to overlap by one if or more within one pixel, and a tonal representation is performed by making the combination of the size and the number of the dots in each pixel variable, wherein said print data generating step comprises a step for generating print data corresponding to a smoothing pattern, and wherein said print data generating step comprises a step for referring to pattern table for converting the data in order to perform smoothing by controlling the emission timing for each ink particle.

25. An on-demand inkjet printer comprising:

an inkjet head which moves in the main scanning direction of a recording medium;

a drive waveform generator unit for generating a drive waveform for emitting a ink particle to form dots of a same size, in a cycle that is 1/n of the cycle for one pixel, with one pixel including a maximum number of n ink particles;

a print data generator unit for generating print data of a plurality of bits or selecting said drive waveform within the cycle for one pixel; and a head drive unit for driving the nozzles of said head, by selecting said drive waveform in accordance with said print data, wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive way form for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform, in accordance with said print data;

wherein volume of the ink particle emitted by the first drive waveform and volume of the ink particle emitted by the second drive waveform are different from each other.

26. A drive device for an inkjet head moving in a main scanning direction of a recording medium, comprising:

a drive waveform generator unit for generating a drive waveform for emitting a ink particle to form dots of a same size in a cycle that is 1/n of the cycle for one pixel, with one pixel including a maximum number of n ink particles;

a print data generator unit for generating print data of a plurality of bits or selecting said drive waveforms in the cycle for one pixel; and a head drive unit for driving the nozzles of said head, by selecting said drive waveform in accordance with said print data, wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive way form for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform in accordance with said print data;

wherein volume of the ink particle emitted by the first drive waveform and volume of the ink particle emitted by the second drive waveform are different from each other.

27. A drive method for an inkjet head moving in a main canning direction of a recording medium, comprising:

a drive waveform generating step for generating a drive waveform for emitting a ink particle to form dots of a same size in a cycle that is 1/n of the cycle for one pixel, with one pixel including a maximum number of n ink particles;

a print data generating step for generating print data of a plurality of bits or selecting said drive waveform in said cycle for one pixel; and a head driving step for driving the nozzles of said head, by selecting said drive waveform in accordance with said print data, wherein said drive waveform generating step comprises a step for generating a first drive waveform for emitting an ink particle to form dots of a first same size within a cycle that is an integral fraction of the cycle for one pixel, and a second drive waveform for emitting an ink particle to form dots of a second same size within a cycle that is an integral fraction o the cycle for one pixel;

wherein said head driving step comprises a driving step for driving the nozzles of said head by selecting either said first drive waveform or said second drive waveform, in accordance with said print data, wherein volume of the ink particle emitted by the first drive waveform and volume of the ink particle emitted by the second drive waveform are different from each other.

28. An on-demand inkjet printer comprising:

an inkjet head which moves in the main scanning direction of a recording medium;

a drive waveform generator unit for generating a drive waveform for emitting a ink particle to form dots of a same size, in a cycle that is an integral fraction of the cycle for one pixel;

a print data generator unit for generating print data of a plurality of bits or selecting said drive waveform within the cycle for one pixel; and a head drive unit for driving the nozzles of said head, by selecting said drive waveform in accordance with said print data, wherein said print data generator unit generates print data in such a manner that the dots selected within said cycle for one pixel are continuous, wherein said print data generator unit includes a decoder for generating print data corresponding to a tone level for said one pixel and generating print data corresponding to a smoothing pattern, wherein, in each tone, the dot positioned in the center of the pixel is always allocated, and then subsequent dots are allocated in the adjacent direction, and thereby, the surface area tone is created in the center of the pixel, wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive way form for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform, in accordance with said print data;

wherein volume of the ink particle emitted by the first drive waveform and volume of the ink particle emitted by the second drive waveform are different from each other.

29. A drive device for an inkjet head moving in a main canning direction of a recording medium, comprising:

a drive waveform generator unit for generating a drive waveform for emitting a ink particle to form dots of a same size in a cycle that is an integral fraction of the cycle for one pixel;

a print data generator unit for generating print data of a plurality of bits or selecting said drive waveforms in the cycle for one pixel; and a head drive unit for driving the nozzles of said head, by selecting said drive waveform in accordance with said print data, wherein said print data generator unit generates print data in such a manner that the dots selected within said cycle for one pixel are continuous, wherein said print data generator unit includes a decoder for generating print data corresponding to a tone level for said one pixel and generating print data corresponding to a smoothing pattern, wherein, in each tone, the dot positioned in the center of the pixel is always allocated, and then subsequent dots are allocated in the adjacent direction, and thereby, the surface area tone is created in the center of the pixel, and wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive way form for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform, in accordance with said print data;

wherein volume of the ink particle emitted by the first drive waveform and volume of the ink particle emitted by the second drive waveform are different from each other.

30. A drive method for an inkjet head moving in a main canning direction of a recording medium, comprising:

a drive waveform generating step for generating a drive waveform for emitting a ink particle to form dots of a same size in a cycle that is an integral fraction of the cycle for one pixel;

a print data generating step for generating print data of a plurality of bits for selecting said drive waveform in said cycle for one pixel; and a head driving step for driving the nozzles of said head, by selecting said drive waveform in accordance with said print data, wherein said print data generating step comprises a step for generating print data in such a manner that the dots selected within said cycle for one pixel are continuous, wherein said print data generating step comprises a step for generating print data corresponding to a tone level for said one pixel and generating print data corresponding to a smoothing pattern, wherein, in each tone, the dot positioned in the center of the pixel is always allocated, and then subsequent dots are allocated in the adjacent direction, and thereby, the surface area tone is created in the center of the pixel, wherein said drive waveform generating step comprises a step for generating a first drive waveform for emitting an ink particle to form dots of a first same size within cycle that is an integral fraction of the cycle for one pixel, and a second drive waveform for emitting an ink particle to form dots of a second same size within a cycle that is an integral fraction of the cycle for one pixel;

wherein said head driving step comprises a driving step for driving the nozzles of said head by selecting either said first drive waveform or said second drive waveform, in accordance with said print data, wherein volume of the ink particle emitted by the first drive waveform and volume of the ink particle emitted by the second drive waveform are different from each other.

31. An on-demand inkjet printer comprising:

an inkjet head which moves in the main scanning direction of a recording medium;

a drive waveform generator unit for generating a drive waveform for emitting a ink particle to form dots of a same size, in a cycle that is an integral fraction of the cycle for one pixel;

a print data generator unit for generating print data of a plurality of bits for selecting said drive waveform within the cycle for one pixel; and a head drive unit for driving the nozzles of said head, by selecting said drive waveform in accordance with said print data, wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive waveform for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform, in accordance with said print data, wherein the adjacent dots of the same size are caused to overlap by one half or more within one pixel, and a tonal representation is performed by making the combination of the size and the number of the dots in each pixel variable, wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive way form for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform, in accordance with said print data;

wherein volume of the ink particle emitted by the first drive waveform and volume of the ink particle emitted by the second drive waveform are different from each other.

32. A drive device for an inkjet head moving in a main scanning direction of a recording medium, comprising:

a drive waveform generator unit for generating a drive waveform for emitting a ink particle to form dots of a same size in a cycle that is an integral fraction of the cycle for one pixel;

a print data generator unit for generating print data of a plurality of bits or selecting said drive waveforms in the cycle for one pixel; and a head drive unit for driving the nozzles of said head, by selecting said drive waveform in accordance with said print data, wherein said drive waveform generator unit comprises:

a first drive waveform generator unit for generating a first drive waveform for emitting a ink particle to form dots of a first same size within a cycle that is an integral fraction of the cycle for one pixel; and a second drive waveform generator unit for generating a second drive waveform for emitting a ink particle to form dots of a second same size within a cycle that is an integral fraction of the cycle for one pixel;

wherein said head drive unit comprises a drive unit for driving the nozzles of said head by selecting either said first drive waveform or said second drive waveform in accordance with said print data, wherein the adjacent dots of the same size are caused to overlap by one half or more within one pixel, and a tonal representation is performed by making the combination o the size and the number of the dots in each pixel variable, wherein said drive waveform generator unit comprises:

a first drive waveform generator unit for generating a first drive waveform for emitting ink particles to form dots of a first same size within a cycle that is an integral fraction of the cycle for one pixel; and a second drive waveform generator unit for generating a second drive waveform for emitting ink particles to form dots of a second same size within a cycle that is an integral fraction of the cycle for one pixel;

wherein said head drive unit comprises a drive unit for driving the nozzles of said head by selecting either said first drive waveform or said second drive waveform, in accordance with said print data;

wherein volume of the ink particle emitted by the first drive waveform and volume of the ink particle emitted by the second drive waveform are different from each other.

33. A drive method for an inkjet head moving in a main scanning direction of a recording medium, comprising:

a drive waveform generating step for generating a drive waveform for emitting a ink particle to form dots of a same size in a cycle that is an integral fraction of the cycle for one pixel;

a print data generating step for generating print data of a plurality of bits for selecting said drive waveform in said cycle for one pixel; and a head driving step for driving the nozzles of said head, by selecting said drive waveform in accordance with said print data, wherein said drive waveform generating step comprises a step for generating a first drive waveform for emitting an ink particle to form dots of a first same size within a cycle that is an integral fraction of the cycle for one pixel, and a second drive waveform for emitting an ink particle to form dots of a second same size within a cycle that is an integral fraction of the cycle for one pixel;

wherein said head driving step comprises a driving step for driving the nozzles of said head by selecting either said first drive waveform or said second drive waveform, in accordance with said print data, wherein the adjacent dots of the same size are caused to overlap by one half or more within one pixel, and a tonal representation is performed by making the combination of the size and the number of the dots in each pixel variable, wherein volume of the ink particle emitted by the first drive waveform and volume of the ink particle emitted by the second drive waveform are different from each other.

* * * * *